US008269128B2

(12) United States Patent
Ren

(10) Patent No.: US 8,269,128 B2
(45) **Date of Patent: *Sep. 18, 2012**

(54) VACUUM SWITCH TUBE

(75) Inventor: Jianchang Ren, Beijing (CN)

(73) Assignee: Beijing Orient Vacuum Electric Co., Ltd., Beijing (CN)

( * ) Notice: Subject to any disclaimer, the term of this patent is extended or adjusted under 35 U.S.C. 154(b) by 416 days.

This patent is subject to a terminal disclaimer.

(21) Appl. No.: 12/698,861

(22) Filed: Feb. 2, 2010

(65) Prior Publication Data

US 2011/0186548 A1 Aug. 4, 2011

(51) Int. Cl.
*H01H 33/66* (2006.01)

(52) U.S. Cl. ..... 218/127; 218/123

(58) Field of Classification Search ..... 218/10, 218/118, 123–128, 146
See application file for complete search history.

(56) References Cited

U.S. PATENT DOCUMENTS 4,021,633 A * 5/1977 Kuwabara et al. ..... 200/262
4,636,600 A * 1/1987 Lipperts ..... 218/129
5,254,817 A * 10/1993 Inagaki ..... 218/132
6,853,525 B2 * 2/2005 Hetzmannseder et al. ..... 361/56
2004/0035827 A1 * 2/2004 Ren ..... 218/123
2004/0035828 A1 * 2/2004 Jianchang ..... 218/123
2011/0042354 A1 * 2/2011 Blalock et al. ..... 218/29

* cited by examiner

*Primary Examiner* — Amy Cohen Johnson
*Assistant Examiner* — Marina Fishman
(74) *Attorney, Agent, or Firm* — J.C. Patents

(57) ABSTRACT

A vacuum switch tube is provided, which includes a first conductive rod disposed with a first contact and a second conductive rod disposed with a second contact. The first contact and the second contact are disposed facing each other and sealed in a vacuum tube body. Contact bodies of the first contact and the second contact are spheres with spherical caps at two ends being cut off. The first contact and the second contact respectively include conductive members and magnetic members extending in the same direction and joining with each other to form the contact bodies. The cross section shape of the magnetic members is divided by a neutrality line into two unequal regions. The magnetic member of the first contact and the conductive member of the second contact are correspondingly disposed. The conductive member of the first contact and the magnetic member of the second contact are correspondingly disposed. The vacuum switch tube of the present invention can generate a rotating magnetic field in a vacuum gap formed between contact surfaces of two vacuum switch contacts in a vacuum arc-extinguishing chamber, so as to increase high-voltage resistant capability of the vacuum switch tube, which can be applied in a vacuum switch device of a higher voltage circuitry.

7 Claims, 5 Drawing Sheets

VACUUM SWITCH TUBE

FIELD OF THE TECHNOLOGY

The present invention relates to a vacuum switch tube, and more particularly to a vacuum switch tube with corresponding contacts disposed in an arc-extinguishing chamber, which belongs to the field of electrical technology.

BACKGROUND

A switch device has been widely applied in various circuits, which functions to turn on and turn off the circuits. When contacts of the switch device are disconnected, an arc is generated and a plasma arc having a column as a conical surface is generated from the combustion at the cathode spot. Especially in a high-voltage circuit, the arc generated by the switch is extremely intense.

When the switch is in an ON status, the switch device should have a lower resistance to allow a rating current to pass through and produce no excessively high temperature. In a process of disconnecting the switch contacts, the arc-extinguishing process needs to be performed, so that the switch contacts are disconnected resolutely. The switch device in the prior art usually adopts oil, sulfur hexafluoride (SF6), air, semiconductor, or vacuum for arc-extinguishing. Different arc-extinguishing media have different characteristics and corresponding switch structures. As the vacuum switch has smaller gaps, higher voltage-resistant capability, lower arc voltage, higher current breaking capability, lower power wear, and longer electrical endurance, the vacuum switch has been widely applied in various power circuits.

A core member of a vacuum switch tube is a vacuum arc-extinguishing chamber, and vacuum switch contacts in the vacuum arc-extinguishing chamber are key members of the vacuum arc-extinguishing chamber. The performance of the vacuum switch contacts decides the performance of the vacuum switch tube. Therefore, how to improve the performance of the vacuum switch contacts is a key point for improving the performance of the vacuum switch tube.

In the vacuum switch tube in the prior art, the vacuum contacts are usually cylinders. A magnetic member and a conductive member are disposed in each contact body. When the vacuum switch tube is disconnected, a contact area of contacts at two ends of the vacuum switch tube gradually decreases, until only one contact point is left between the contacts. At the same time, a contact resistance gradually increases, such that a temperature of an area where the contact point is located gradually rises. Once the temperature is higher than a melting point of the contact point, the contact point is melted, evaporated, and ionized. The metal vapor maintains the discharging in vacuum, so as to generate a vacuum arc. At this time, the key point of the successful current breaking is that an insulation recovery speed at the gaps of the contacts is higher than a transient recovery voltage speed at the gaps of the contacts after the crossing zero of the arc current, such that re-ignition does not occur and the current breaking is successful. During the current breaking in the vacuum arc-extinguishing chamber, the metal vapor released by the arc diffuses rapidly during the crossing zero of the arc current and is condensed instantly upon encountering the contacts or surface of a shielding case. Therefore, the influencing factors such as size, material, or form of contacts, gap between contacts, density of the metal vapor generated during current breaking, and density of charged particles need to be designed properly. Generally speaking, a desirable vertical magnetic field formed between contacts depending on the magnetic members can accelerate arc-extinguishing, which has excellent performance of insulation recovery after arcing.

However, the structure of vacuum contacts in the current vacuum switch tube still has problems such as an electric field concentration, insufficient voltage resistant capability, and higher re-ignition possibility during high-voltage breaking, which fails to satisfy the demand of a higher voltage circuitry. Especially, with the wide application of higher voltage transmission circuitries in the electric power equipment, the higher requirement for the voltage resistant capability of the vacuum switch tube is proposed. How to design a vacuum switch tube with a higher voltage resistant capability to satisfy the demands of higher voltage circuitries has become an urgent technical problem currently.

SUMMARY

The present invention is directed to provide a vacuum switch tube, which is applicable to reduce re-ignition possibility during voltage breaking, decrease an arc voltage, realize effective arc-extinguishing, and satisfy high-voltage breaking requirements.

In order to realize the above objective, the present invention provides a vacuum switch tube, which includes a first conductive rod and a second conductive rod. A first contact is disposed at an end of the first conductive rod. A second contact is disposed at an end of the second conductive rod. The first contact and the second contact are disposed facing each other and sealed in a vacuum tube body. Contact bodies of the first contact and the second contact are spheres with spherical caps at two ends being cut off. The first contact and the second contact respectively include conductive members and magnetic members extending in the same direction and joining with each other to form the contact bodies. The cross section shape of the magnetic members is divided by a neutrality line into two unequal regions; and the magnetic member of the first contact and the conductive member of the second contact are correspondingly disposed, and the conductive member of the first contact and the magnetic member of the second contact are correspondingly disposed.

Preferably, a shape of a cross section of the contact bodies of the first contact and the second contact is equally divided into an upper left region, a lower left region, an upper right region, and a lower right region by its own horizontal midline and vertical midline. The upper right region is divided into a first upper right region adjacent to the upper left region and a second upper right region other than the first upper right region. The lower left region is divided into a first lower left region adjacent to the lower right region and a second lower left region other than the first lower left region. The conductive member is disposed in the first upper right region, the upper left region, and the second lower left region. The magnetic member is disposed in the first lower left region, the lower right region, and the second upper right region.

Preferably, the first upper right region and/or the first lower left region are half circle, a diameter edge of the first upper right region is adjacent to the upper left region, and a diameter edge of the first lower left region is adjacent to the lower right region. The shape of the half circle region also may be replaced by circle-crown, trapezoid or triangular.

Preferably, each of the contact bodies of the first contact and the second contact is disposed in a cylindrical metal shell respectively.

The contact bodies of the first contact and the second contact are respectively formed by a plurality of sheets laminated in sequence. Each of the sheets is formed by conductive sheets and magnetic sheets joining and combining with each other. A plurality of conductive sheets form the conductive members. A plurality of magnetic sheets form the magnetic members.

Furthermore, securing holes penetrating each of the sheets are further opened in the conductive sheets and the magnetic sheets. Securing columns are inserted in the securing holes. One end of each of the securing columns is secured at a bottom portion inside the metal shell.

Alternatively, the contact bodies consist of a plurality of conductive and magnetic poles or particles adjacent each other closely.

The present invention provides a vacuum switch tube. In one aspect, each vacuum contact in the vacuum switch tube adopts a sphere with spherical caps at two ends being cut off. In another aspect, and the shape of the magnetic members is unequal. Therefore, rotating lines of magnetic force having a rotating shape are formed in the vacuum chamber of the vacuum switch tube in use, so that the current breaking capability of the vacuum switch tube is enhanced, an arc voltage is decreased, and the high-voltage resistant capability of the vacuum switch tube is enhanced, and thus the vacuum switch tube is especially suitable for serving as a switch device in a high-voltage electric circuitry.

The technical solutions of the present invention are further illustrated below in detail with reference to the accompanying drawings and embodiments.

DETAILED DESCRIPTION

The present invention provides a vacuum switch tube, in which rotating lines of magnetic force are formed in a vacuum gap between vacuum contacts in a vacuum arc-extinguishing chamber, so that the current breaking and high-voltage resistant capabilities of the vacuum switch tube are enhanced efficiently, thereby satisfying a demand for a switch in a high-voltage electric power equipment. Specifically, the vacuum switch tube of the present invention includes a first conductive rod and a second conductive rod. A first contact is disposed at an end of the first conductive rod. A second contact is disposed at an end of the second conductive rod. The first contact and the second contact are disposed facing each other and sealed in a vacuum tube body. Contact bodies of the first contact and the second contact are spheres with spherical caps at two ends being cut off. The first contact and the second contact include conductive members and magnetic members extending in the same direction and joining with each other to form the contact bodies respectively. The shape of the magnetic members may be a unequal shape in which the area of one end is larger than that of another end, that is, the cross section shape of the magnetic members is divided by a neutrality line into two unequal regions. The technical solutions do not depart from the scope of the present invention, as long as the cross section shape of the magnetic members in the vacuum switch contacts has the above shape characteristics. The magnetic member of the first contact and the conductive member of the second contact are correspondingly disposed. The conductive member of the first contact and the magnetic member of the second contact are correspondingly disposed.

Figure 1:
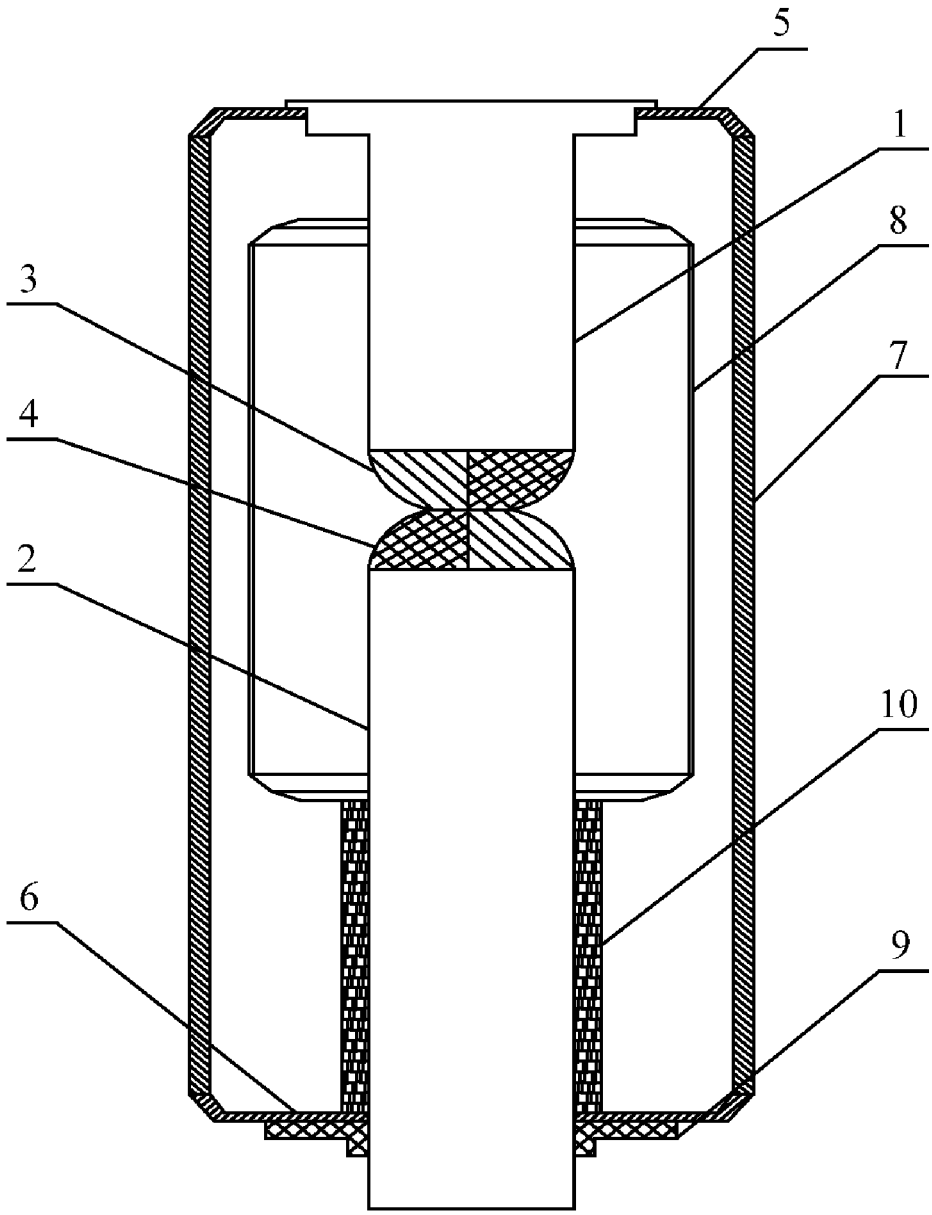
FIG. 1 is a schematic structural view of a vacuum switch tube according to a first embodiment of the present invention.
Figure 2:
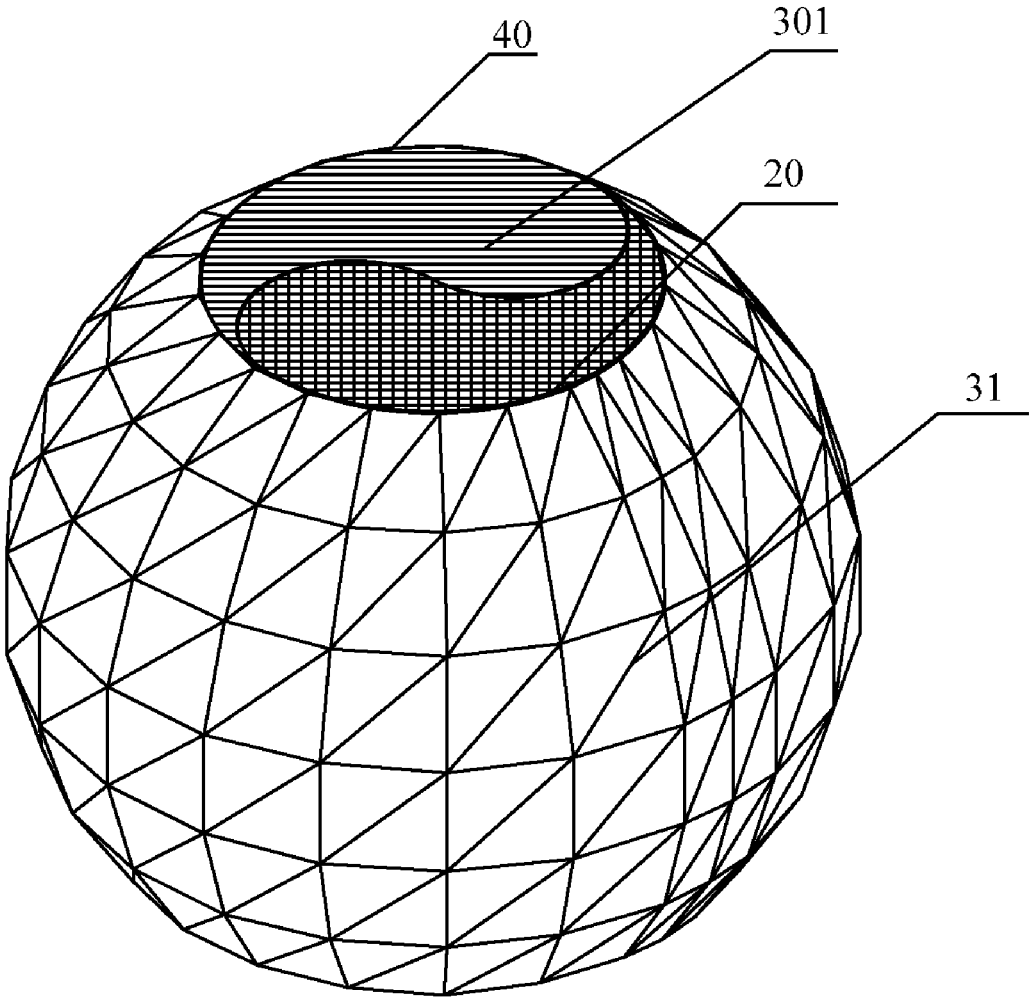
FIG. 2 is a schematic structural view of a first contact of the vacuum switch tube according to the first embodiment of the present invention.

FIG. 1 is a schematic structural view of a vacuum switch tube according to a first embodiment of the present invention. The vacuum switch tube in this embodiment includes a first conductive rod 1 and a second conductive rod 2. A first contact 3 is disposed at a lower end of the first conductive rod 1. A second contact 4 is disposed at an upper end of the second conductive rod 2. The first contact 3 and the second contact 4 are sealed in a vacuum tube body 8, so as to form a vacuum arc-extinguishing chamber. The first conductive rod 1 is fixed in an insulating housing 7 through a first end cover plate 5. The second conductive rod 2 is slidably disposed at a lower end of the insulating housing 7 through a second end cover plate 6. A guide sleeve 9 is disposed outside the second end cover plate 6, and slidably matches with a portion of the second conductive rod 2 protruding out of the second end cover plate 6. A bellows 10 is further disposed inside the insulating housing 7, the second conductive rod 2 is slidably disposed in the bellows 10, and two ends of the bellows 10 contact the vacuum tube body 8 and the insulating housing 7 respectively. FIG. 2 is a schematic structural view of a first contact of the vacuum switch tube according to the first embodiment of the present invention. Referring to FIG. 2, the first contact 3 in this embodiment includes a conductive member 40 and a magnetic member 20. The conductive member 40 and the magnetic member 20 extend in the same direction and join with each other to form a contact body, and the contact body is a sphere 31 with spherical caps at two ends being cut off. A contact surface 301 for contacting the second contact is disposed on a plane of one end of the sphere 31. An arc-resistant layer is coated on the contact surface 301. The conductive member 40 and the magnetic member 20 extend along an axial direction of the sphere 31, and can generate rotating lines of magnetic force on the contact surfaces of two vacuum contacts during use. The conductive member 40 and the magnetic member 20 match with each other in shape, and the conductive member 40 and the magnetic member 20 have substantially the same size. The conductive member 40 and the magnetic member 20 may well match with each other to form a contact body as a sphere with spherical caps at two ends being cut off.

In this embodiment, a structure of the second contact is the same as that of the first contact. The magnetic member of the first contact and the conductive member of the second contact are correspondingly disposed. The conductive member of the first contact and the magnetic member of the second contact are correspondingly disposed. That is, the magnetic members of the first contact and the second contact are anti-symmetrically disposed. The conductive members and the magnetic members of the first contact and the second contact extend along an axial direction of the sphere, respectively generate rotating lines of magnetic force on the contact surfaces, and eventually form a rotating magnetic field loop at a vacuum gap between the contact surfaces of the first contact and the second contact in the vacuum arc-extinguishing chamber.

Figure 3:
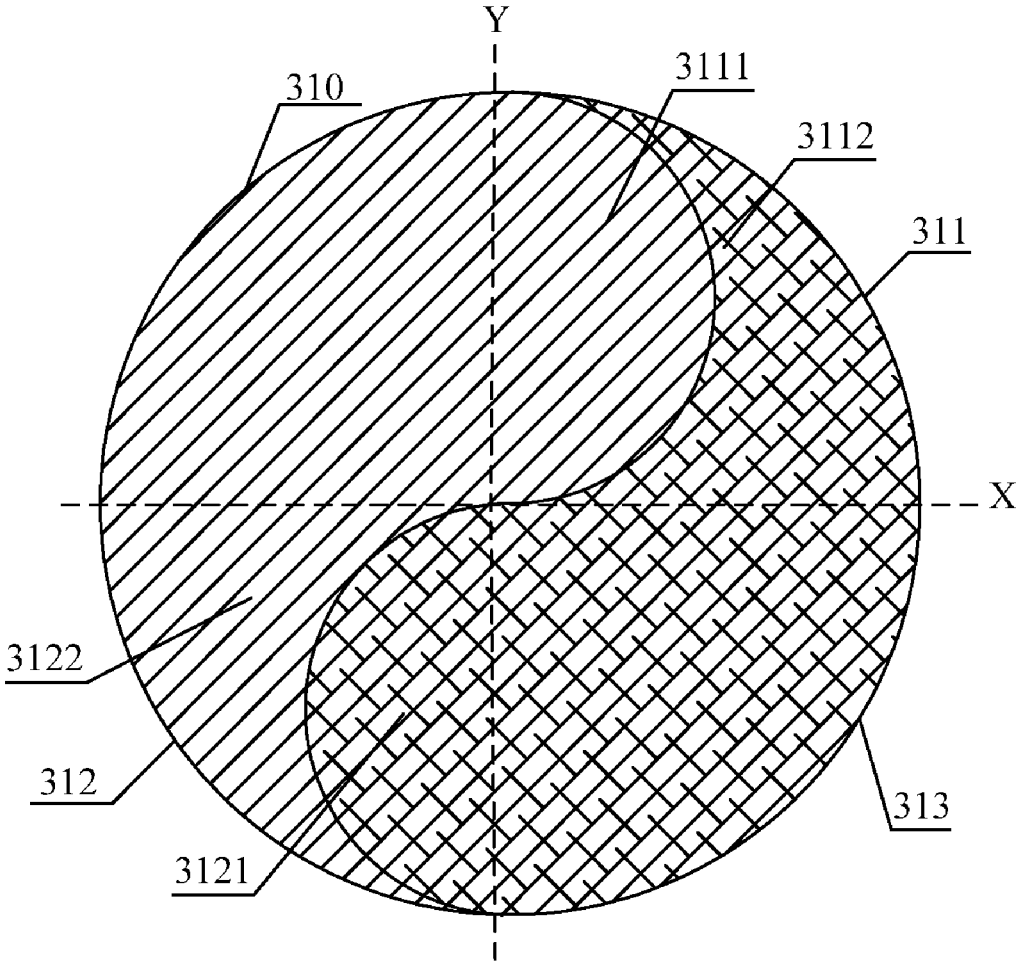
FIG. 3 is a schematic view of a cross section of the first contact of the vacuum switch tube according to the first embodiment of the present invention.

In this embodiment, the cross sections of both the first contact and the second contact may be set as yin-yang-fish shapes of the same size. Specifically, taking the first contact as an example, the neutrality line is defined as follows: one region with arbitrary shape has a maximum characteristic length line. The region could be sandwiched between two parallel lines perpendicular to the characteristic length line, and the two parallel lines have a maximum distance and subject to a restriction that they could touch this region. A central line having the same distance depart from the two parallel lines is the neutrality line of this region. As shown in FIG. 3, when the cross section of the magnetic member is sandwiched between two parallel lines which have the maximum distance, the transverse central line X of the contact body is the neutrality line of the cross section shape of the magnetic member. As shown in FIG. 3, the cross section of the contact body is circular, which is equally divided into an upper left region 310, a lower left region 312, an upper right region 311, and a lower right region 313 by its own horizontal midline X and vertical midline Y. The upper right region 311 is divided into a first upper right region 3111 adjacent to the upper left region 310 and a second upper right region 3112 other than the first upper right region 3111. The lower left region 312 is divided into a first lower left region 3121 adjacent to the lower right region 313 and a second lower left region 3122 other than the first lower left region 3121. The conductive member 40 is disposed in the first upper right region 3111, the upper left region 310, and the second lower left region 3122. The magnetic member 20 is disposed in the first lower left region 3121, the lower right region 313, and the second upper right region 3112. The shapes of the first upper right region 3111 and the first lower left region 3121 are half circles with diameters equal to a radius of the cross section of the contact body. A diameter edge of the half circle in the first upper right region 3111 is adjacent to the upper left region 310. A diameter edge of the half circle in the first lower left region 3121 is adjacent to the lower right region 313. That is, the shape of the cross section of the contact body is a yin-yang-fish shape. As the yin-yang-fish shape of the magnetic member 20 has a bigger end and a smaller end, the lines of magnetic force generated at the bigger end are much more than that generated at the smaller end. The magnetic members of the first contact 3 and the second contact 4 are anti-symmetrically disposed, such that the lines of magnetic force generated at the bigger end of the magnetic member of the first contact 3 certainly flow into the smaller end of the magnetic member of the second contact 4. Therefore, a magnetic field with a rotating shape is generated between the contact surfaces of the two vacuum contacts disposed facing each other, so that the current breaking capability and high-voltage resistant capability of the vacuum switch tube are enhanced, thereby satisfying a demand of the electric power equipment for a vacuum switch tube with a high-voltage resistant capability.

In this embodiment, the whole parts of the magnetic members and the conductive members of the first contact 3 and the second contact 4 are respectively formed into spheres with spherical caps at two ends being cut off. The magnetic members of the first contact 3 and the second contact 4 are anti-symmetrically disposed, so as to generate a rotating magnetic field at the vacuum gap between the contact surfaces of the two vacuum switch contacts. That is, the lines of magnetic force form a rotating closed magnetic field loop between the contact surfaces of the vacuum contacts disposed facing each other, such that the vacuum switch tube has better current breaking capability, the high-voltage resistant capability of the vacuum switch tube is enhanced, and the vacuum switch tube is suitable for higher voltage circuitries, thereby satisfying the high-voltage resistant requirements for a vacuum switch tube in an electric power equipment.

In this embodiment, in one aspect, the first contact and the second contact of the vacuum switch tube adopt spheres with spherical caps at two ends being cut off. In another aspect, the cross sections of the magnetic members of the first contact and the second contact have yin-yang-fish shapes. Rotating lines of magnetic force having a rotating shape are formed at the vacuum gap between the contact surfaces of the two vacuum contacts, so that the current breaking capability of the vacuum switch tube is enhanced, an arc voltage is decreased, the high-voltage resistant capability of the vacuum switch tube is enhanced, and thus the vacuum switch tube is especially suitable for a switch device in a high-voltage electric power equipment. The technical solution in this embodiment can realize the capability of breaking voltages of higher than 40.5 kilovolts, for example, break voltages such as 55 kilovolts, 72.5 kilovolts, and 110 kilovolts.

Particularly, the shape of the conductive members and the magnetic members in the contact bodies is not limited to be yin-yang-fish matched. When the cross section of the contact bodies is divided by using the above way, the shape of the half circle regions also may be replaced by circle-crown, trapezoid, triangular, polygon, trapezoid-like or other shapes.

Figure 4:
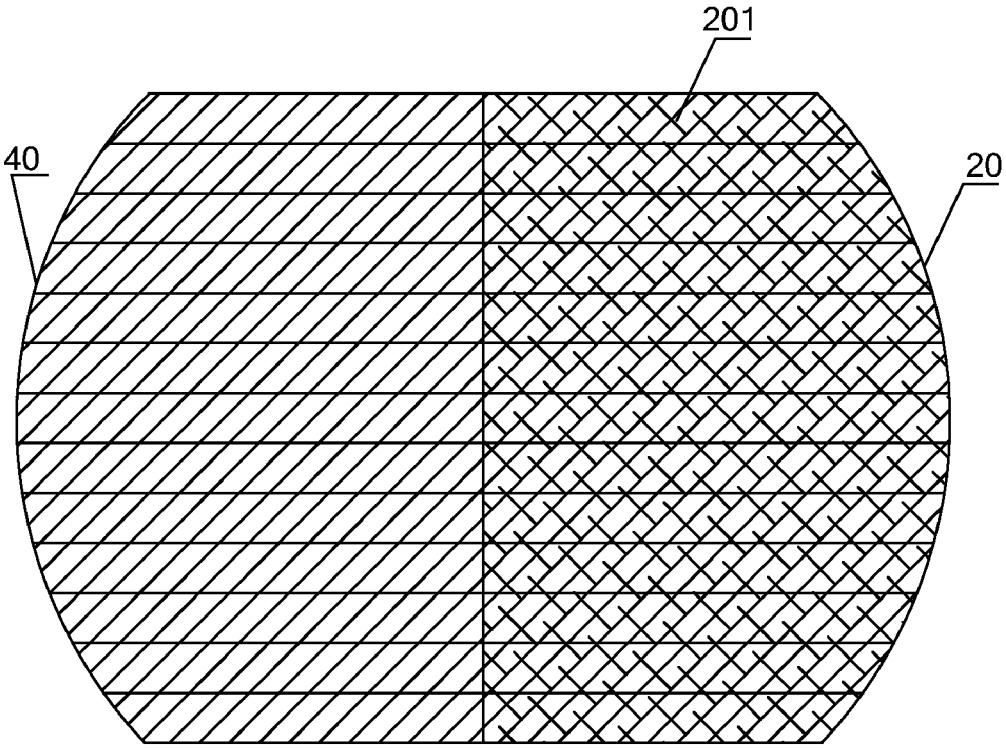
FIG. 4 is a schematic sectional view of a first contact of a vacuum switch tube according to a second embodiment of the present invention.

FIG. 4 is a schematic sectional view of a first contact of a vacuum switch tube according to a second embodiment of the present invention. On the basis of the first embodiment, in this embodiment, contact bodies of a first contact and a second contact are respectively formed by a plurality of sheets laminated in sequence. Taking the first contact as an example, each of the sheets is formed by magnetic sheets and conductive sheets joining and combining with each other. A plurality of conductive sheets forms a conductive member. A plurality of magnetic sheets forms a magnetic member. Specifically, the magnetic member is formed by a plurality of magnetic sheets 201 laminated together. The magnetic sheets 201 may be made of a soft magnetic material. In this embodiment, the magnetic sheets are all made of electrical pure iron. The shape of the conductive member is the same as that of the magnetic member and the conductive member is formed by various conductive sheets laminated together. The conductive sheets are made of copper or silver. In this embodiment, all the sheets are laminated together to form a shape of an external profile of the contact body. Outside of the contact bodies of the first contact and the second contact, cylindrical metal shells may be further disposed respectively, such that the contacts are disposed in the metal shells to form a vacuum switch tube.

The technical solution in this embodiment further simplifies the manufacturing process of the contact bodies. After a plurality of sheets is prepared through a simple molding process, the sheets may be put in a metal shell corresponding to the profile shape of the conductive member or profile shape of the magnetic member. Then, the sheet metal is melted over heating, so as to form the conductive member and the magnetic member respectively, and form an integral contact body.

Figure 5:
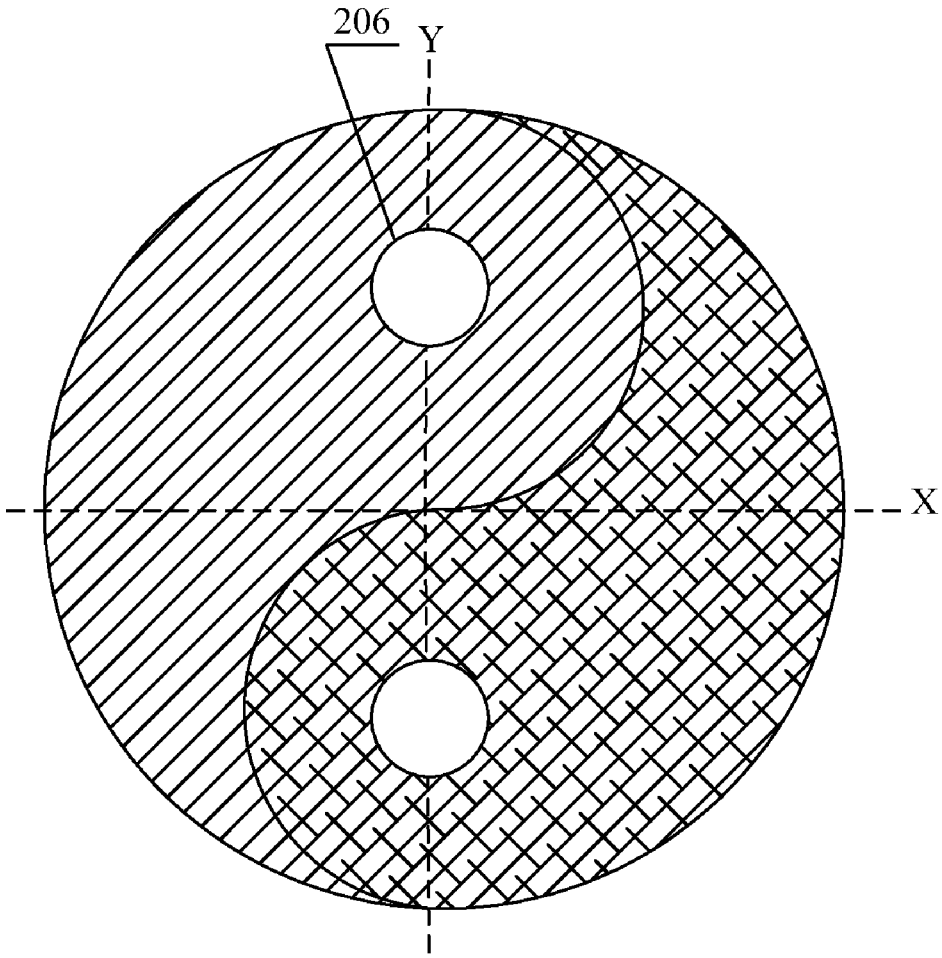
FIG. 5 is a schematic view of a cross section of a first contact of a vacuum switch tube according to a third embodiment of the present invention.

FIG. 5 is a schematic view of a cross section of a first contact of a vacuum switch tube according to a third embodiment of the present invention. On the basis of the second embodiment, in this embodiment, fixed holes for enabling fixed rods 206 to penetrate a plurality of sheets are further opened in the conductive sheets and the magnetic sheets. The fixed rod penetrating the conductive member may be made of the same material as the conductive member, for example, copper or silver. The fixed rod penetrating the magnetic member may be made of the same material as the magnetic member, for example, electrical pure iron. The fixed rods are disposed to facilitate the assembling and fixing operations of the conductive sheets and the magnetic sheets. The fixed rods may be disposed in a metal shell having a shape matching with the contact shape. Specifically, the fixed rods may be fixed at a bottom portion inside the metal shell.

The technical solution in this embodiment utilizes the fixed rods to fix the fabricated sheets together, so as to facilitate the assembling and fixing operations of the sheets, thereby further simplifying the manufacturing process of the contact bodies.

The contact bodies are not limited to consist of sheets, and the contact bodies also may be consist of a plurality of conductive and magnetic poles or particles adjacent each other closely.

In the above embodiments of the present invention, the second contact has the same structure as the first contact.

Finally, it should be noted that the above embodiments are merely provided for describing the technical solutions of the present invention, but not intended to limit the present invention. It should be understood by persons of ordinary skill in the art that, although the present invention has been described in detail with reference to the preferred embodiments, modifications or equivalent replacements can still be made to the technical solutions of the present invention, as long as such modifications or equivalent replacements do not cause the modified technical solutions to depart from the spirit and scope of the present invention.

What is claimed is:

1. A vacuum switch tube, comprising: a first conductive rod and a second conductive rod, a first contact is disposed at an end of the first conductive rod, a second contact is disposed at an end of the second conductive rod, the first contact and the second contact are disposed facing each other and sealed in a vacuum tube body, wherein, contact bodies of the first contact and the second contact are spheres with spherical caps at two ends being cut off; the first contact and the second contact respectively comprise conductive members and magnetic members extending in the same direction and joining with each other to form the contact bodies; the cross section shape of the magnetic members is divided by a neutrality line into two unequal regions; and the magnetic member of the first contact and the conductive member of the second contact are correspondingly disposed, and the conductive member of the first contact and the magnetic member of the second contact are correspondingly disposed.

2. The vacuum switch tube according to claim 1, wherein a shape of a cross section of the contact bodies of the first contact and the second contact is equally divided into an upper left region, a lower left region, an upper right region, and a lower right region by a horizontal midline and a vertical midline thereof; the upper right region is divided into a first upper right region adjacent to the upper left region and a second upper right region other than the first upper right region; the lower left region is divided into a first lower left region adjacent to the lower right region and a second lower left region other than the first lower left region, the conductive member is disposed in the first upper right region, the upper left region, and the second lower left region, the magnetic member is disposed in the first lower left region, the lower right region, and the second upper right region.

3. The vacuum switch tube according to claim 2, wherein the first upper right region and/or the first lower left region are half circle, a diameter edge of the first upper right region is adjacent to the upper left region, and a diameter edge of the first lower left region is adjacent to the lower right region.

4. The vacuum switch tube according to claim 1, wherein the first contact and the second contact are disposed in a cylindrical metal shell respectively.

5. The vacuum switch tube according to claim 4, wherein the contact bodies of the first contact and the second contact are respectively formed by a plurality of sheets laminated in sequence, each of the sheets is formed by conductive sheets and magnetic sheets joining and combining with each other, a plurality of conductive sheets form the conductive members, a plurality of magnetic sheets form the magnetic members.

6. The vacuum switch tube according to claim 5, wherein fixed holes penetrating each of the sheets are opened in the conductive sheets and the magnetic sheets, fixed rods are inserted in the fixed holes.

7. The vacuum switch tube according to claim 4, wherein the contact bodies consist of a plurality of conductive and magnetic poles or particles adjacent each other closely.

* * * * *